US006418651B1

(12) United States Patent
Joliey

(10) Patent No.: US 6,418,651 B1
(45) Date of Patent: Jul. 16, 2002

(54) ELECTRONIC LABELING SYSTEM

(75) Inventor: Bernard Joliey, Cour Cheverny (FR)

(73) Assignee: Store Electronic Systems Communication, Vendenheim (FR)

( * ) Notice: Subject to any disclaimer, the term of this patent is extended or adjusted under 35 U.S.C. 154(b) by 0 days.

(21) Appl. No.: 09/446,181

(22) PCT Filed: Jun. 16, 1998

(86) PCT No.: PCT/FR98/01256

§ 371 (c)(1),
(2), (4) Date: Feb. 1, 2000

(87) PCT Pub. No.: WO98/58360

PCT Pub. Date: Dec. 23, 1998

(30) Foreign Application Priority Data

Jun. 18, 1997 (FR) ..... 97 07586
Dec. 2, 1997 (FR) ..... 97 15172

(51) Int. Cl.[7] ..... G09F 3/18
(52) U.S. Cl. ..... 40/642.02; 40/661.03; 40/621
(58) Field of Search ..... 40/642.02, 661.03, 40/662, 449, 600, 621; 248/223.41, 225.11

(56) References Cited

U.S. PATENT DOCUMENTS 4,184,277 A * 1/1980 Larin ..... 40/661.01
5,348,485 A 9/1994 Briechle et al.
5,473,832 A * 12/1995 Briechle et al. ..... 40/124.05
5,553,412 A * 9/1996 Briechle et al. ..... 40/124.01
5,575,100 A * 11/1996 Marvin et al. ..... 40/642.02
6,035,569 A * 3/2000 Nagel et al. ..... 40/661.03
6,119,990 A * 9/2000 Kump et al. ..... 248/220.22
6,126,125 A * 10/2000 Dalton ..... 248/205.2
6,189,248 B1 * 2/2001 Nagel et al. ..... 40/661.03

FOREIGN PATENT DOCUMENTS

EP 0 683 478 11/1995
GB 2249854 A * 5/1992
WO WO 93/19448 9/1993
WO WO 94/22125 9/1994

* cited by examiner

*Primary Examiner*—B. Dayoan
*Assistant Examiner*—William L. Miller
(74) *Attorney, Agent, or Firm*—Young & Thompson

(57) ABSTRACT

Electronic labeling system includes a rail for supporting labels and at least one electronic display label, the rail having two facing wings with each of the wings having in its medial region a longitudinal groove, the electronic label having on one of its two opposite edges a longitudinal rib adapted to be inserted in the groove of one of the rail wings and on the other of the opposite edges at least one retractable pin adapted to snap into the groove of the other rail wing, and at least one recess in which is disposed a ferromagnetic core carrying the pin which is urged to project from the corresponding edge of the label, the core being adapted to be displaced in the recess by magnetic attraction to retract the pin and free the label.

12 Claims, 2 Drawing Sheets

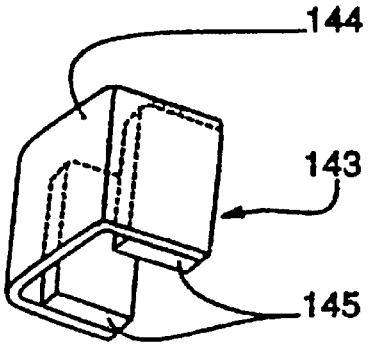
FIG. 6
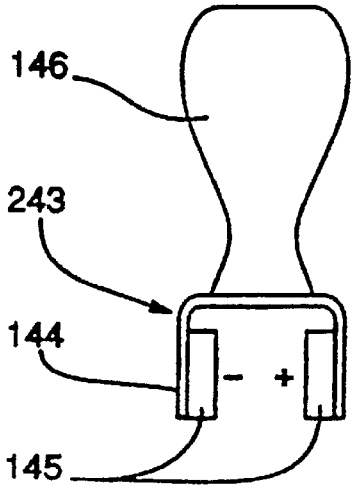
FIG. 7
FIG. 5
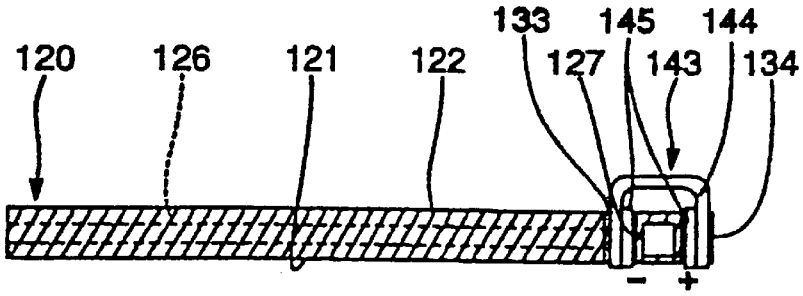
FIG. 4
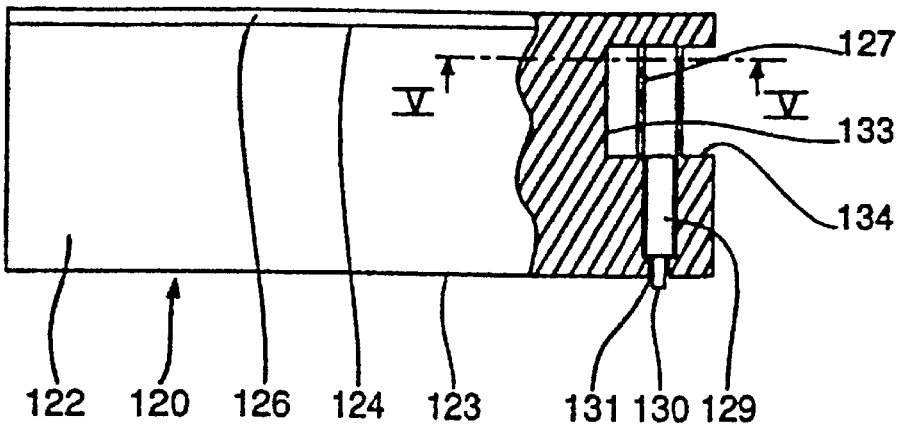

ELECTRONIC LABELING SYSTEM

BACKGROUND OF THE INVENTION

The invention relates to an electronic labeling system.

DESCRIPTION OF THE RELATED ART

Electronic labeling is widely used, particularly in large stores which are provided with shelves of metallic material serving to display products offered for sale. In general, the edge of the shelf carries a rail of insulating plastic material, within which are provided supply conductors for the display labels. Electronic labels are snapped onto the rail. When they are in snapped-on position, their contacts are in electrical contact with the conductors of the rail, and they are able to display a price, or code, for example. When a label is defective, it is removed and replaced.

To replace a label, it is usual to use a tool which acts on the side of the label. When the label is accessible from the side, it is thus easy to remove a label, either by vandalism or for a collection.

So as to avoid the theft of labels, it is desirable that the snapping on have a semi-permanent character, which is to say that the label cannot be removed other than with a special tool. This precaution is sometimes insufficient. To increase security, certain labels cannot be withdrawn from the rail after emplacement. It is thus possible to slide them on the rail to a lockable position, provided for their withdrawal. This solution is not without its drawbacks. Thus, to withdraw a label, it is necessary also to slide all the labels located between the label to be withdrawn and the position provided for their removal. Moreover, the labels cannot be fixed in position and they can be easily moved, which upsets their display on the shelf.

SUMMARY OF THE INVENTION

An object of the invention is to provide an electronic label display system in which the labels are emplaced by snapping on to the desired position and are not susceptible to being moved. Another object of the invention is to provide an electronic label display system in which the labels are adapted to be removed by means that are very simple to use.

The invention has for its object an electronic labeling system comprising a label support rail, at least one electronic display label and means for supplying energy to the label, characterized in that

- the label support rail comprises two confronting wings extending in a longitudinal direction each of the two rings having in its medial region a longitudinal groove; and
- the electronic label comprises on one of two of its opposite edges a longitudinal rib adapted to be inserted in the groove of one of the wings of the rail, and on the other of said opposite edges at least one retractable pin adapted to snap into the groove of the other wing of the rail.

According to other characteristics:

- each pin is adapted to be received in one of a series of blind holes arranged at regular intervals in the groove of said other wing of the rail to immobilize the label in a locked position;
- the longitudinal groove of said other wing of the rail, which is adapted to coact with the pin, has a longitudinal sawtooth profile, the space between two teeth being adapted to receive the pin to immobilize the label;

- the electronic display label comprises at least one recess in which is disposed a ferromagnetic core carrying the pin which is urged to project from the corresponding edge of the label;
- the ferromagnetic core carries at the base of the pin a shock absorber disposed in the mentioned recess;
- a spring is disposed in the recess to urge the pin to project from the corresponding edge of the label;
- the pin is provided to project from the lower edge of the label, such that the pin will be urged toward this edge under the action of gravity;
- extraction means for the label is provided, comprising a magnetic circuit adapted to attract the ferromag-netic core so as to ensure retraction of the pin toward the recess and freeing of the label;
- after freeing the label, the extraction means attracts the label and ensures its extraction from the rail, and the withdrawal of the extraction means causes withdrawal of the label;
- the extraction means is constituted by a housing containing the magnetic circuit and having at least one arm bearing on the rail;
- the housing has two arms adapted to be disposed on opposite sides of the rail, the magnetic circuit then being automatically in the correct position to attract the ferromag-netic core and to ensure retraction of the pin and freeing of the label;
- the label comprises on opposite sides of the recess a through free space adapted to receive respectively one arm of the extraction means each carrying a magnet of opposite polarity to attract the pin to withdraw it into the recess;
- the extraction means has a general U shape of which the bottom is connected to a sleeve for its gripping and whose arms bear internally magnets of opposite polarity.

BRIEF DESCRIPTION OF THE DRAWINGS

Other characteristics will become apparent from the description which follows, given with reference to the accompanying drawings, in which:

FIG. 4 is a view of the front surface partially broken away, of a label according to another embodiment of the invention;

FIG. 5 is a cross-sectional view on the line V—V of FIG. 4, during presentation of the extraction means for the label;

FIG. 6 is a perspective view of the extraction means of FIG. 5; and

FIG. 7 is a view from above of a modified embodiment of the extraction means suitable for the label of FIG. 4.

DESCRIPTION OF THE PREFERRED EMBODIMENTS

Figure 1:
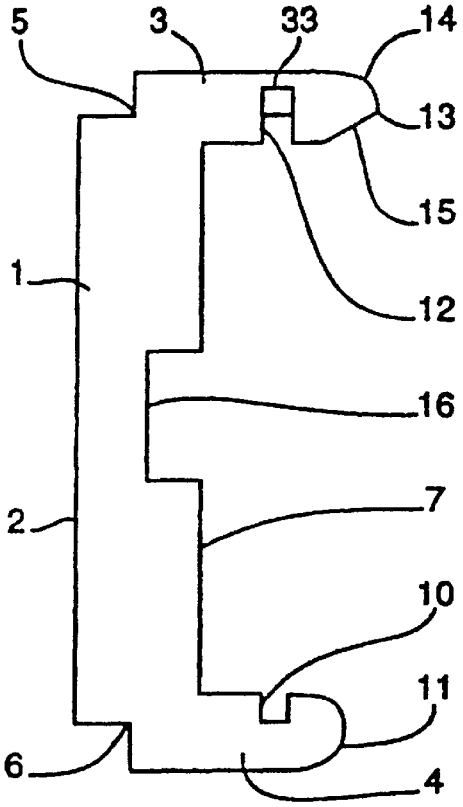
FIG. 1 is a schematic view in transverse cross-section of one embodiment of an insulating rail for an electronic labeling system according to the invention.

In FIG. 1, there is shown a rail 1 of insulating plastic material. This rail 1 has a U-shaped profile with a flat bottom 2, an upper wing 3 and a lower wing 4. Between the bottom 2 and each of the wings 3 and 4 is provided a notch, respectively 5 and 6, on the outer contour.

In its medial region, the lower wing 4 has on its internal profile a longitudinal groove 10. The end 11 of the lower wing 4 is rounded.

The upper wing 3 has on its internal profile and in its medial region, a longitudinal groove 12 in which are provided, at regular intervals, blind holes 33.

The end 13 of the upper wing 3 has an external rounded profile 14 and an internal chamfered profile 15. In its medial region, the bottom of rail 1 preferably has on its internal surface 7 a longitudinal trench 16, usable for example to receive the securement means of the rail 1 on its support.

Figure 2:
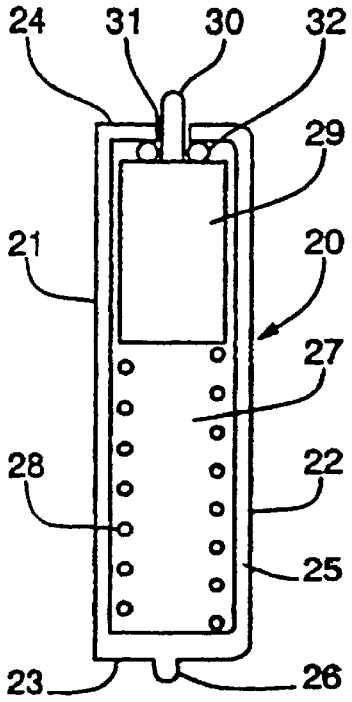
FIG. 2 is a schematic transverse cross-sectional view of one embodiment of an electronic display label suitable for the rail of FIG. 1.

In FIG. 2, the electronic display label 20 is shown in cross-section in the vertical plane passing through a snap-on means.

Figure 3:
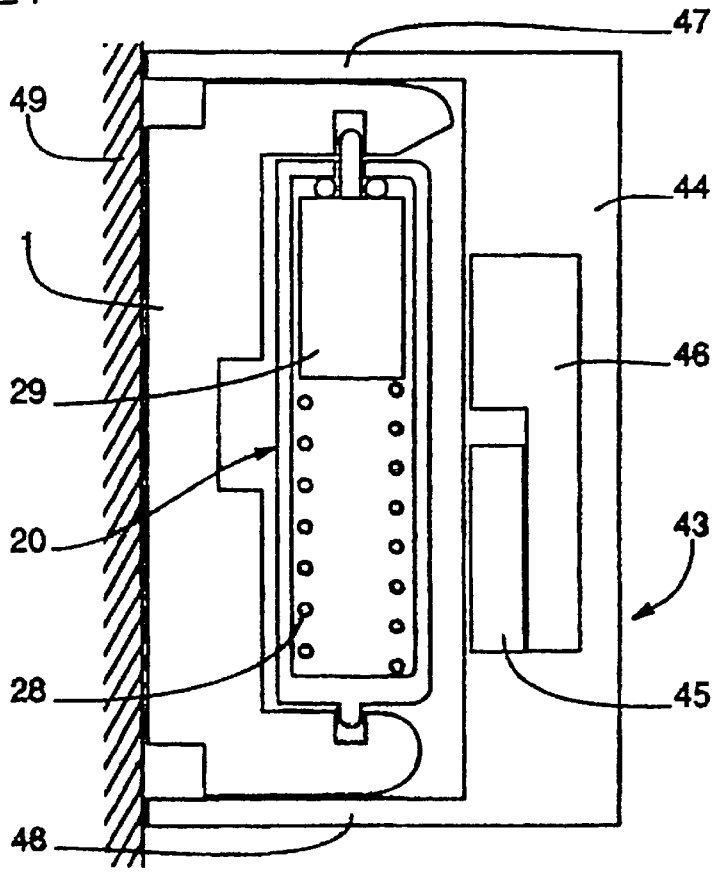
FIG. 3 is a schematic transverse cross-sectional view of the rail of FIG. 1 provided with the label of FIG. 2, during presentation of the extraction means of the label.

The label 20 is present in the form of a rectangular parallelepiped, of which only the transverse cross-section is visible in FIG. 3.

The label is comprised by a thin envelope 25 of plastic material whose four surfaces visible in FIG. 3 are the rear surface 21, the front surface 22, the lower surface 23 and the upper surface 24.

The front surface 22 is transparent and lets one see a liquid crystal display screen, for example, under the control of a microprocessor, itself connected to the central computer of the store, to display a price or information.

The lower surface 23 has in its medial region, a longitudinal rib 26 preferably with a rounded profile. This rib 26 is adapted to be inserted in the groove 10 of the lower wing 4 of the rail 1.

Within the envelope 25, the label 20 comprises at least one recess 27 extending over at least a portion of its height, and in which is disposed snap-on means. In the embodiment shown in FIG. 2, this snap-on means is comprised by a spiral spring 28, disposed at the bottom of the recess 27, and a ferromagnetic core 29 urged upwardly by the spring 28, and a pin 30 carried by the core 29 and adapted to project through an opening 31 in the upper surface 24 of the label 20. At the base of the pin 30, between the ferromagnetic core 29 and the envelope 25 of the label 20, is preferably provided a shock absorber, in the form of a ring 32.

To mount the label 20 in the rail 1, the lower portion is first inserted, the rib 26 being inserted in the groove 10 of the rail 1. The rib 26 serving as a pivotal axis, the upper portion of the label 20 is pressed toward the bottom of the rail 1.

The pin 30 is applied to the inner chamfered profile 15 which presses it inwardly of the label 20 by compressing the spring 28.

When the label 20 is near its normal operating position, the pin 30 penetrates, under the action of the spring 28, the groove 12 of the upper wing 3 of the rail 1. The label 20 is thus in operative position.

The label 20 is then moved along the rail, by sliding, until the pin 30 penetrates, under the action of the spring 28, one of the blind holes 33. These blind holes are for example spaced from each other by about 1 cm. The label 20 is then in locked position.

In FIG. 3, the rail 1 and the label 20 are shown in normal operating position.

The extraction means 43 for the label is shown in its approaching position, before unlocking the label 20. This approach is frontal relative to the rail and the label. The extraction means 43 for the label comprises essentially a housing 44 of plastic material and a magnetic circuit constituted a magnet 45 and a ferromagnetic core 46.

The housing 44 is in the form of a rectangular parallelepiped provided with two arms 47 and 48 enclosing the rail 1 and adapted to bear on the support 49 of the rail 1. When the arms 47 and 48 are in abutment against the support of the rail 1, and the housing 44 is in front of the label, the magnetic circuit has an air gap substantially facing the bottom of the ferromagnetic core 29. The core 29 is thus attracted downwardly, and moves to compress the spring 28, such that the pin 30, which follows the displacement of the core 29, leaves the blind hole 33 in which it is disposed in the locking position, and leaves the groove 12, thereby freeing the label 20 which is applied to the housing 44 and follows the withdrawal movement of the housing 44. The label 20 is then manually separated from the housing 44, and the core 29 is then returned by the spring 28, the pin 30 resuming its position projecting from outside the envelope 25 of the label 20.

The housing 44 need only comprise a single arm, 47 or 48, and in this case it is correctly positioned by pressing simultaneously on the support 49 of the rail and on the rail 1 itself, for example by lateral pressure against one wing, 3 or 4, respectively, of the rail 1.

The provision of at least 1 arm 47, 48 on the housing 44 ensures the automatic correct position of the magnetic circuit 45–46 relative to the magnetic core 29 for unlocking the label. Then, the core 29 is attracted by the magnetic circuit 45–46 and moves the label against the housing 44, which plays the role of a gripping member for the label.

The invention has been described in the case of an embodiment which is not limiting. In particular, the means for supplying the label with power, and also with information, is not described and can be a wire transmission, a radio electric or infrared transmission, or a capacitative or inductive transmission, or the like.

Moreover, the longitudinal groove 12 of the upper wing 3 of the rail 1 can be provided with open holes, or else its longitudinal profile can be saw-toothed, the space between two teeth being adapted to receive the pin to immobilize the label.

FIGS. 4–7 will now be described, which show another embodiment of the invention.

In the framework of this modification, the rail 1 shown in FIG. 1 will be inverted to have the longitudinal groove 10 upwardly of the rail and the longitudinal groove 12 provided with its blind holes 33 at the base of the rail, for reasons which will be indicated later.

The electronic display label 120 here comprises an upper edge 124 which is provided with a longitudinal rib 126 adapted to be inserted in the upper groove of the rail. On its lower opposite edge 123, a pin 130 projects which passes through an opening 131 opening into a recess 127 which contains a ferromagnetic core 129 carrying at its base the pin 130. Of course, the recess 127 has a height greater than that of the core 129, to permit its displacement and withdrawal of the pin 130 at the interior of the recess 127 when the extraction means 143 for example is used.

On the side of the recess 127 oriented inwardly of the label, a window 133 opening on the front surface 122 and the rear surface 121 of the label 120 is provided through the thickness of the label, whilst on the other side of the recess 127 is provided a through notch 134 opening on the side edge 135 of the label. The window 133 and the notch 134 are adapted to receive the arm of the extraction means 143, as will be explained later. The notch 134 has the function of permitting the passage of one arm of the extraction means 143 on the side of the recess 127 when two labels are secured to each other by their side edges. Otherwise, the notch 134 could be omitted, the arm corresponding to the extraction means 143 simply coming against the edge 135 of the label. Of course it is necessary in this case to provide the snap-in means adjacent side edge 135 of the label. Otherwise, a window symmetrical to the window 133 should be provided on the other side of the recess 137.

It will be seen in FIG. 4 that the spring 28 of the first embodiment has been omitted because the pin 130 is in this case urged to project from the lower edge 123 by gravity acting on the pin 130 and its core 129. The window 33 and the notch 134 are at the same height and offset along the recess 127 relative to the core 129, so as to attract upwardly this latter when the extraction means 143 is emplaced.

Referring more particularly to FIGS. 6 and 7, it will be seen that the extraction means 143 has a general U shape whose lateral arms each carry internally a magnet 145 of opposite polarity, to create a magnetic circuit attracting the ferromagnetic core 129 upwardly. In the modification of FIG. 7, the bottom of the U-shaped support 144 is connected to a handle 146 to facilitate its gripping.

As an alternative, the recess 127 could be provided with a spring similar to the above spring 28, to urge the pin 130 upwardly, when the label 120 of FIG. 4 is inverted.

Conversely, the spring 28 of the embodiment of FIGS. 1 and 3 could be omitted, by using the rail 1 and the label 20 inverted.

Although the invention has been described in connection with several particular embodiments, it is of course evident that it is thereby in no way limited and that it comprises all technical equivalents of the described means as well as their combinations if the latter enter into the scope of the invention.

What is claimed is:

1. Electronic labeling system, comprising;

at least one electronic display label;

a rail for supporting the label; and means for supplying energy to the label, the rail (1) for supporting labels (20) comprising two facing wings (3, 4) extending in a longitudinal direction, each of the two wings (3, 4) having in its medial region a longitudinal groove (12, 10), the electronic label (20, 120) comprising on one (23, 124) of its two opposite edges a longitudinal rib (26, 126) adapted to be inserted in the groove (10) of one (4) of the wings of the rail (1), characterized in that the electronic label (20, 120) comprises on the other (24, 123) of said opposite edges at least one retractable pin (30, 130) adapted to snap into the groove (12) of the other wing (3) of the rail (1), and at least one recess (27, 127) in which is disposed a ferromagnetic core (29, 129) carrying the pin (30, 130) which is urged to project from the corresponding edge (24, 123) of the label, said core being adapted to be displaced in said recess by magnetic attraction to retract said pin and free the label.

2. System according to claim 1, characterized in that the at least one retractable pin (30, 130) is adapted to be received in one of a series of blind holes (33) arranged at regular intervals in the groove (12) of said other wing (3) of the rail (1).

3. System according to claim 1, characterized in that the longitudinal groove (12) of said other wing (3) of the rail (1), which is adapted to coact with the pin (30, 130), has a longitudinal sawtooth profile, a space between two teeth being adapted to receive the pin to immobilize the label.

4. System according to claim 1, characterized in that the pin includes a base and the ferromagnetic core (29, 129) carries at the base of the pin (30, 130) a shock absorber (32) disposed in the least one recess (27, 127) in which the ferromagnetic core (29, 129) is disposed.

5. System according claim 1 characterized in that a spring (28) is disposed in the recess (27) to urge the pin (30) to project from the corresponding edge (24) of the label (20).

6. System according to claim 1, characterized in that the pin (130) is provided to project from a first edge (123) of the label (120), such that the pin will be urged toward this first edge under the action of gravity.

7. System according to claim 1, further comprising an extraction means (43, 143, 243) for the label (20, 120), the extraction comprising a magnetic circuit (45, 46; 145) adapted to attract the ferromagnetic core (29, 129) so as to ensure the retraction of the pin (30, 130) toward the recess (27, 127) and the freeing of the label (20, 120).

8. System according to claim 7, wherein, the extraction means (43) after freeing the label, attracts the label (20) and ensures its extraction from the rail (1), and the withdrawal of the extraction means (43) causes withdrawal of the label (20).

9. System according to claim 7, characterized in that the extraction means (43) is constituted by a housing (44) containing the magnetic circuit (45–46) and having at least one arm bearing on the rail (1).

10. System according to claim 9, characterized in that the housing (44) has two arms (47, 48) bearing on the rail, the two arms being adapted to be disposed on opposite sides of the rail (1), the magnetic circuit (45–46) being thus automatically in the correct position to attract the ferromagnetic core (29) and to ensure withdrawal of the pin (30) and freeing of the label (20).

11. System according to claim 7, characterized in that the label (120) comprises on opposite sides of the recess (127) a through free space (133, 134) adapted to receive respectively one arm of the extraction means (143) each carrying a magnet of opposite polarity (145) to attract the pin (130) retracted in the recess (127).

12. System according to claim 11, characterized in that the extraction means (143) has a general U shape, the extraction means having a bottom connected to a handle (146) for gripping and having arms carrying internal magnets (145) of opposite polarity.

* * * * *